United States Patent [19]

Ramsey

[11] Patent Number: 4,928,855

[45] Date of Patent: May 29, 1990

[54] DISPENSER APPARATUS FOR BEVERAGE BOTTLES

[76] Inventor: John A. Ramsey, 14831 Easingwold, Houston, Tex. 77015

[21] Appl. No.: 226,865

[22] Filed: Aug. 1, 1988

[51] Int. Cl.[5] ..... B67D 5/60

[52] U.S. Cl. ..... 222/131; 222/183; 222/185; 222/325; 222/481.5; 222/484; 137/587

[58] Field of Search ..... 222/131, 181, 183, 185; 222/481.5, 484, 487, 325; 137/587, 588, 801, 625.18

[56] References Cited

U.S. PATENT DOCUMENTS

| | | | |
|---|---|---|---|
| 620,262 | 2/1899 | Tong | 137/588 |
| 737,767 | 9/1903 | Pigrenet | 137/588 |
| 1,125,450 | 1/1915 | Bonnell | 222/185 X |
| 1,207,278 | 12/1916 | Cordley | 137/588 X |
| 2,046,474 | 7/1936 | Maggenti | 137/625.18 X |
| 2,239,921 | 4/1941 | Majewski, Jr. | 222/487 |
| 2,264,671 | 12/1941 | Kocher | 137/588 X |
| 3,042,267 | 7/1962 | Reynard | 222/185 |
| 3,933,275 | 1/1976 | Metzner | 222/131 |
| 4,293,082 | 10/1981 | Matsueda | 222/185 X |
| 4,715,516 | 12/1987 | Salvail | 222/487 X |
| 4,722,463 | 2/1988 | Anderson | 222/484 X |

*Primary Examiner*—Joseph J. Rolla
*Assistant Examiner*—Gregory L. Huson
*Attorney, Agent, or Firm*—Neal J. Mosely

[57] ABSTRACT

A dispenser apparatus is shown for beverages and more particularly a dispenser apparatus for one or more large size carbonated beverage bottles. The dispenser apparatus comprises a supporting base having a top surface with one or more vertical openings each configured to receive and hermetically seal the open end of a large size carbonated beverage bottle in an inverted position and a horizontal front opening for each vertical opening. A short vertical passageway in the base extends from each top opening and a horizontal passageway extending from each front opening to open into the vertical passageways. A bleed passageway extends horizontally substantially in parallel to each horizontal passageway from each front opening and then vertically through each vertical opening to a point adjacent to the bottom of an inverted carbonated beverage bottle installed on the apparatus. The supporting base top openings each have a removable tubular threaded insert operable to receive and seal the threaded top of a bottle of selected size. A valve comprising a valve housing with a pair of valve openings and a pair of valve members controlling the same is provided for each front opening. Separate valve operator members are provided for each valve for independent, selective operation of the valve members. A removable cover is supported on the base in an inverted position of a size and shape enclosing the bottles supported thereon.

11 Claims, 1 Drawing Sheet

DISPENSER APPARATUS FOR BEVERAGE BOTTLES

BACKGROUND OF THE INVENTION

1. FIELD OF THE INVENTION

This invention relates generally to beverage dispensers, and more particularly to a dispenser for one or more large size carbonated beverage bottles.

2. BRIEF DESCRIPTION OF THE PRIOR ART

Devices are known for dispensing water or other beverages from bottles. In particular, dispensers are common for large size, e.g., five or ten gallon, water bottles. Also, dispensers are common for dispensing beverage concentrates from bottles and mixing the same for production of carbonated beverages. The introduction of large size, e.g., one and two liter, bottles of carbonated beverages has resulted in a considerable use of such sizes, but the large sizes are awkward to handle.

There are several patents which disclose various types of dispensers for various liquids.

Hodge et al, U.S. Pat. No. 3,434,629 discloses a dispenser for a liquid mouthwash from a bottle, the dispenser having a valved outlet and a holder for cups to receive the mouthwash.

Parker et al U.S. Pat. No. 3,738,388 discloses a valve system for dispensing beer from a manifold leading from a plurality of beer kegs.

Slagle U.S. Pat. No. 3,930,598 discloses a liquid dispensing apparatus having a plurality of receptacles receiving separate beverage bottles which discharge into a common manifold.

Neidorf U.S. Pat. No. 4,033,483 discloses another liquid dispensing apparatus having a plurality of receptacles receiving separate beverage bottles which discharge into a common manifold.

Shannon U.S. Pat. No. 4,274,557 discloses another liquid dispensing apparatus having a plurality of receptacles receiving separate beverage bottles which discharge into a common manifold having a selective pumping arrangement.

The present invention is distinguished over the prior art in general, and these patents in particular by an apparatus for dispensing carbonated beverages from large, e.g., one and two liter, bottles which comprises a supporting base with one or more vertical openings configured to receive and hermetically seal the open end of the bottle in an inverted position. The apparatus has a system of passageways and valves to dispensing liquid and bleeding air into the bottle. A removable cover is supported on the base in an inverted position of a size and shape enclosing the bottles supported thereon.

SUMMARY OF THE INVENTION

It is therefore an object of the present invention to provide a new and improved dispensing apparatus for large size bottles.

It is another object of this invention is to provide a new and improved dispensing apparatus for large size carbonated beverage bottles.

Another object of this invention is to provide a new and improved dispensing apparatus for large size carbonated beverage bottles of different sizes.

Another object of this invention is to provide a new and improved dispensing apparatus for large size carbonated beverage bottles through a valved front dispenser.

Still another object of this invention is to provide a new and improved dispensing apparatus for large size carbonated beverage bottles through a valved front dispenser having separate passages for bleeding air into the interior of the bottles and for dispensing carbonated beverage.

Still another object of this invention is to provide a new and improved dispensing apparatus for large size carbonated beverage bottles or different sizes through valved front dispensers with separate passages for bleeding air into the interior of the respective bottles and for dispensing carbonated beverage.

A further object of this invention is to provide an improved dispensing apparatus for large size carbonated beverage bottles having a top cover removable for permitting installation of the bottles in place and having valved front dispensers with separate passages for bleeding air into the interior of the bottles and for dispensing carbonated beverage.

A further object of this invention is to provide an improved dispensing apparatus for large size carbonated beverage bottles having a top cover removable for permitting installation of the bottles in place and a removable tray at the top of the cover.

Other objects of the invention will become apparent from time to time throughout the specification and claims as hereinafter related.

The above noted objects and other objects of the invention are accomplished by a novel dispenser apparatus for one or more large size carbonated beverage bottles. The dispenser apparatus comprises a supporting base having a top surface with one or more vertical openings each configured to receive and hermetically seal the open end of a large size carbonated beverage bottle in an inverted position and a horizontal front opening for each vertical opening. A short vertical passageway in the base extends from each top opening and a horizontal passageway extending from each front opening to open into the vertical passageways. A bleed passageway extends horizontally substantially in parallel to each horizontal passageway from each front opening and then vertically through each vertical opening to a point adjacent to the bottom of an inverted carbonated beverage bottle installed on the apparatus. The supporting base top openings each have a removable tubular threaded insert operable to receive and seal the threaded top of a bottle of selected size. A valve comprising a valve housing with a pair of valve openings and a pair of valve members controlling the same is provided for each front opening. Separate valve operator members are provided for independent, selective operation of the valve members. A removable cover is supported on the base in an inverted position of a size and shape enclosing the bottles supported thereon.

DESCRIPTION OF THE PREFERRED EMBODIMENT

Figure 3:
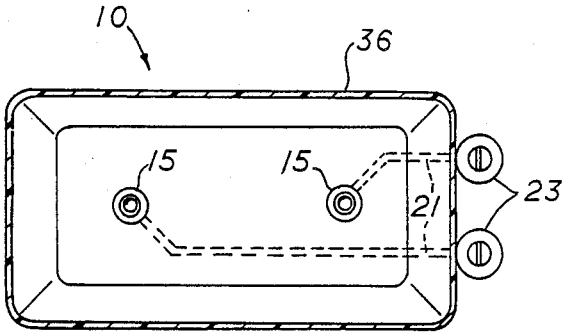
FIG. 3 is a top plan view of the dispenser apparatus for carbonated beverage bottles shown in FIG. 1.
Figure 4:
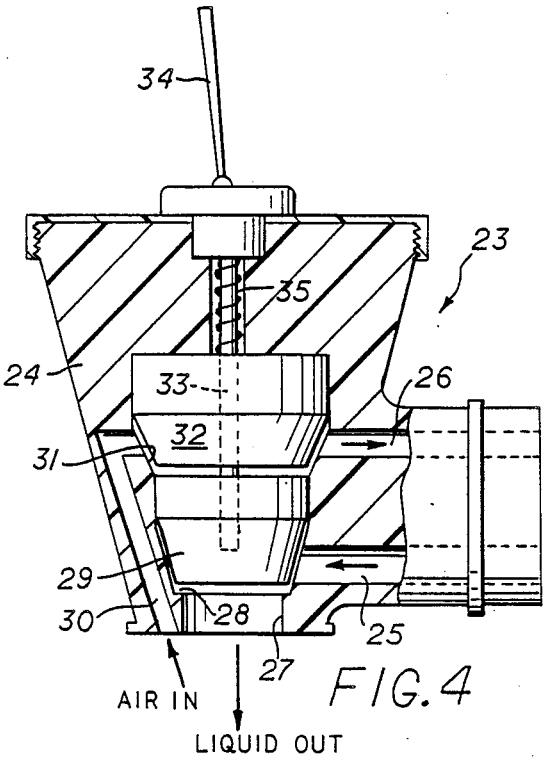
FIG. 4 is a detail sectional view of the dispensing valve for the apparatus shown in FIG. 1.
Figure 2:
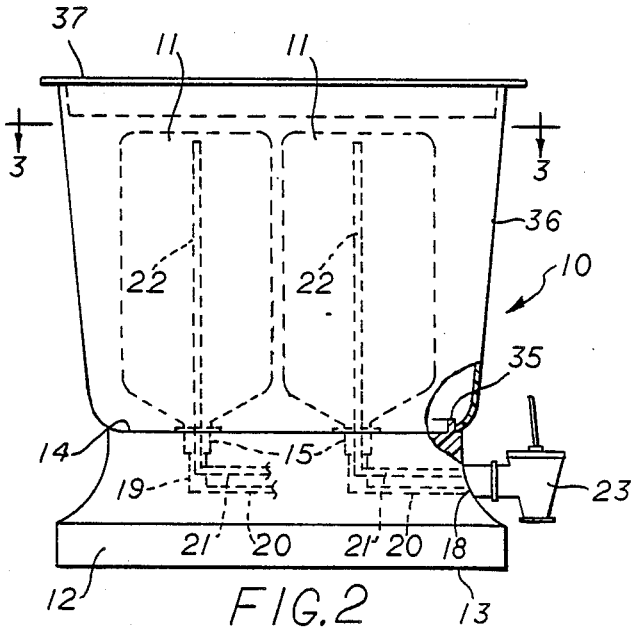
FIG. 2 is a side elevation of the dispenser apparatus for carbonated beverage bottles shown in FIG. 1.
Figure 1:
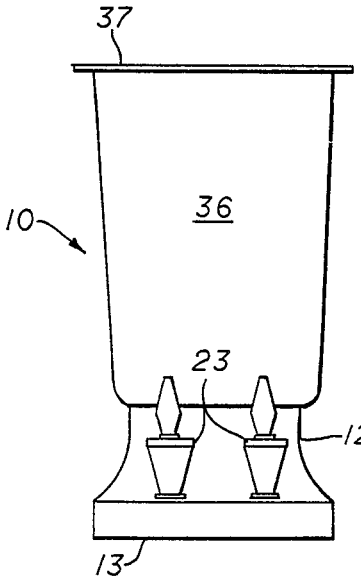
FIG. 1 is a front elevation of a dispenser apparatus for carbonated beverage bottles illustrating a preferred embodiment of this invention.
Figure 5:
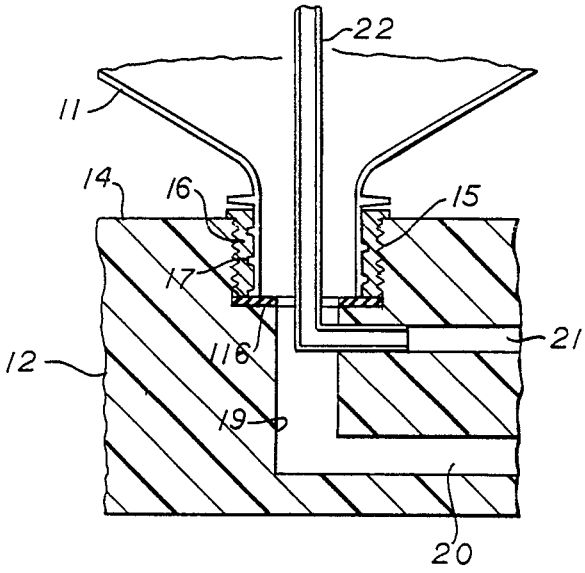
FIG. 5 is a detail sectional view showing the connection of the beverage bottles in place in the apparatus shown in FIG. 1.

Referring to the drawings by numerals of reference, and more particularly to FIGS. 1–3, there is shown a dispenser apparatus 10 for beverages which is especially useful for dispensing beverages from one or more large size carbonated beverage bottles 11. The apparatus is designed to handle two and three liter carbonated beverage bottles and is adjustable for other sizes.

Dispenser apparatus 10 has a supporting base 12 with a bottom surface 13 resting on a table or other support and a top surface 14. Base 12 has one or more vertical openings 15 in top surface 14 each being configured to receive and hermetically seal the open end of a large size carbonated beverage bottle 11 in an inverted position.

The supporting base top openings 15 each have a removable tubular threaded insert or bushing 16 with female threads 17 operable to receive and hermetically seal the threaded top of a bottle of selected size. Washers 116 are positioned between the ends of bushings 16 and the shoulder forming the end of vertically extending openings 15. Bushings 16 are provided for two and three liter beverage bottles and other sizes can be provided on demand.

Base 12 has a horizontal front opening 18 for each of the vertical openings 15. A short vertical passageway 19 in base 12 extends from each top opening 15 and intersects a horizontal passageway 20 extending from each of the front openings 18. A bleed passageway 21 extends horizontally substantially in parallel to each horizontal passageway 20 from each of the front openings 18 and has a vertically extending tube 22 continuing the passageway through each vertical opening 15 to a point adjacent to the bottom of each inverted carbonated beverage bottle 11 installed on the apparatus.

Each of the front openings 18 has a valve 23 installed therein to control the flow of liquid out of passageway 20 and air into bottle 11 through bleed passageway 21. Valve 23 comprises a valve housing 24 with passages 25 and 26 aligned with passages 20 and 21 when installed on base 12. Valve housing 24 has an outlet passage 27 which opens to valve seat 28. Valve member 29 opens and closes the opening through valve seat 28 to control flow of the beverage out of bottle 11 through passageway 20 and outlet opening 27.

Valve housing 24 has an inlet passage 30 which opens to valve seat 31. Valve member 32 opens and closes the opening through valve seat 31 to control flow of air into bottle 11 through tube 22 and bleed passageway 26 from inlet opening 30. Valve members 29 and 32 are mounted for movement together on a valve stem 33 operated by a toggle handle 34 and spring 35. Operation of handle 34 moves valve members 29 and 32 from a closed position to an open position where air can flow into bottle 11 and beverage flow out through opening 27 to a cup or container held below the opening. As seen in FIGS. 1 and 3, this embodiment provides for serving from two of the bottles 11, which may be of the same or different size, by operation either one of the control valves 23.

The upper surface of base 12 has a peripheral rim 35 over which there fits a removable cover 36 in an inverted position. Cover 36 is of a size and shape enclosing the bottles 11 supported thereon. Cover 36 may be of a one-piece construction or may be open at the top with a removable tray or container 37 (for ice or for service) closing the top opening.

OPERATION

While the operation of this invention should be obvious from the foregoing description, it will be restated for clarity. When the apparatus is first used, the caps are removed from bottles Il and the cover 36 is removed from base 12. Base 12 is then inverted over bottles 11 which are then screwed into threaded bushings 16 until a tight fit is obtained. Valves 23 are in a closed position. Base 12 and bottles 11 are then restored to an upright position with the bottles secured in an inverted position on the base. The connection between bottles 11 and base 12 is a tight hermetic seal retaining full carbonation in the bottle. Cover 36 is then fitted in place over bottles 11 and secured on rim 35. With the apparatus assembled in this manner, operation of either of the valve handles 34 will cause the appropriate beverage to be dispensed through valve outlet 27 to a cup or container held below.

While this invention has been described fully and completely with special emphasis upon a preferred embodiment, it should be understood that within the scope of the appended claims the invention may be practiced otherwise than as specifically described herein.

I claim:

1. A dispensing apparatus, for large size bottles for carbonated beverages having open tops normally closed by screw top closures, comprising a supporting base having a top surface with at least one vertical, female-threaded, opening comprising a removable tubular female-threaded insert configured to receive and hermetically seal the open, male-threaded, end of a large size carbonated beverage bottle in an inverted position, and a least one horizontal front opening, a short vertical passageway in said base extending from said top opening, a horizontal passageway extending from said front opening to open into said vertical passageway, a bleed passageway extending horizontally substantially in parallel to said horizontal passageway from said front opening and then vertically through said vertical opening to a point adjacent to the bottom of an inverted carbonated beverage bottle when installed thereon, valve means supported on said base and connected to said horizontal passageway and said bleed passageway operable to open and close said passageways simultaneously to bleed air into a bottle installed thereon and permit flow of a beverage out of the bottle through said front opening, a removable cover supported on said base in an inverted position of a size and shape for enclosing a bottle supported on said base, said removable cover being of a hollow construction fitting over said base and having a removable top closure usable as a serving container.

2. A dispensing apparatus according to claim 1 in which said valve means comprises a valve housing with a pair of valve openings and a pair of valve members controlling the same, and said valve openings being connected to said horizontal passageway and said bleed passageway.

3. A dispensing apparatus according to claim 1 in which said valve means comprises a valve housing with a pair of valve openings and a pair of valve members controlling the same, said valve openings being connected to said horizontal passageway and said bleed passageway, and separate valve operator members supported on a single operating member for selective operation of said valve members.

4. A dispensing apparatus according to claim 1 in which said base has top surface with a plurality of said vertical openings and a least one horizontal front opening for each vertical opening, a plurality of short vertical passageways in said base extending one from each of said top openings, a plurality of horizontal passageways extending one from each of said front openings to open into respective ones of said vertical passageways, a plurality of bleed passageways extending horizontally substantially in parallel to said horizontal passageways from said front openings and then vertically through said vertical openings to a point adjacent to the respective bottoms of the inverted carbonated beverage bottles when installed thereon, and a plurality of valve means supported on said base and connected one to each of said horizontal passageways and bleed passageways operable to open and close said passageways simultaneously to bleed air into respective bottles installed thereon and permit flow of a beverage out of the bottle through selected ones of said front openings.

5. A dispensing apparatus according to claim 4 in which each said supporting base top opening is female threaded to receive and seal the male threaded top of a bottle.

6. A dispensing apparatus according to claim 4 in which said removable cover supported on said base in an inverted position is of a size and shape enclosing a plurality of bottles supported on said base.

7. A dispensing apparatus according to claim 4 in which each said supporting base top opening includes a removable tubular female threaded insert operable to receive and seal the respective male threaded tops of bottles of selected size.

8. A dispensing apparatus according to claim 4 in which each said supporting base top opening includes a removable tubular female threaded insert operable to receive and seal the respective male threaded tops of bottles of selected size, and said removable cover supported on said base in an inverted position is of a size and shape enclosing a plurality of bottles supported on said base.

9. A dispensing apparatus according to claim 4 in which each of said valve means comprises a valve housing with a pair of valve openings and a pair of valve members controlling the same, and said valve openings being connected to respective ones of said horizontal passageways and bleed passageways.

10. A dispensing apparatus according to claim 4 in which each of said valve means comprises a valve housing with a pair of valve openings and a pair of valve members controlling the same, said valve openings being connected to respective ones of said horizontal passageways and bleed passageways, and separate valve operator members on each said valve means for independent, selective operation of said valve members on each said valve means.

11. A dispensing apparatus according to claim 4 in which each of said valve means comprises a valve housing with a pair of valve openings and a pair of valve members controlling the same, said valve openings being connected to respective ones of said horizontal passageways and bleed passageways, and each of said supporting base top openings includes a removable tubular female threaded insert operable to receive and seal a male threaded top of a bottle of selected size.

* * * * *